US005347705A

United States Patent [19]

Schmode et al.

[11] Patent Number: 5,347,705

[45] Date of Patent: Sep. 20, 1994

[54] PLIERS FOR DRESSING CONDUCTOR ENDS

[75] Inventors: Hartmut Schmode, Blomberg; Ulrich Wiebe, Dorentrup; Siegfried Storm, Schlangen; Detlev Hetland, Detmold; Bernd David, Detmold; Hans-Joachim Kornfeld, Vlotho, all of Fed. Rep. of Germany

[73] Assignee: Firma Weidmüller Interface GmbH & Co., Detmold, Fed. Rep. of Germany

[21] Appl. No.: 22,486

[22] Filed: Feb. 25, 1993

[30] Foreign Application Priority Data

Mar. 24, 1992 [DE] Fed. Rep. of Germany ..... 4209529

[51] Int. Cl.[5] ..... H01R 43/04

[52] U.S. Cl. ..... 29/566.4; 29/751

[58] Field of Search ..... 29/566.4, 566.1, 751, 29/861, 758, 750

[56] References Cited

U.S. PATENT DOCUMENTS

| | | | |
|---|---|---|---|
| 3,710,610 | 1/1973 | McCaughey | 29/751 |
| 4,126,936 | 11/1978 | Koller | 29/751 X |
| 4,774,762 | 10/1988 | Gobeil | 29/861 |

FOREIGN PATENT DOCUMENTS

| | | | |
|---|---|---|---|
| 2081999 | 5/1993 | Canada | 29/566.4 |
| 2149167 | 4/1973 | Fed. Rep. of Germany . | |
| 2402187 | 7/1975 | Fed. Rep. of Germany . | |
| 4008515 | 9/1991 | Fed. Rep. of Germany . | |

*Primary Examiner*—William Briggs

[57] ABSTRACT

Pliers for dressing conductor ends have two handles (3, 11) which can move relative to one another, a plurality of dressing stations for the conductor ends, and a drive device (21) via which the dressing stations can be driven during operation of the handles (3, 11). One of the dressing stations is constructed as a crimping drum (18) which can be displaced axially and is supported such that it can rotate and be coupled to the drive device (21) in the axially displaced position over only one dressing process. In this position, the station can be locked via a flange (52) which projects radially from it. This flange (52) extends over the overall circumference of the crimping drum (18) and has at least one recess (51). A locking tab (**50*a*), which is arranged in a fixed position on the body (2) of the pliers and is radially opposite the flange (52), engages, in the undisplaced axial position of the crimping drum (18), into the recess (51), to be precise up to a point close to the outer surface of the crimping drum (18) while, in the axially displaced and rotated position of the crimping drum (18), the locking tab (50*a*) comes to rest above the outer surface of the crimping drum and engages behind the flange (52). Locking of the crimping drum (18) both in the rotational direction and in the axial displacement direction is thus possible by the locking tab (50*a***).

16 Claims, 7 Drawing Sheets

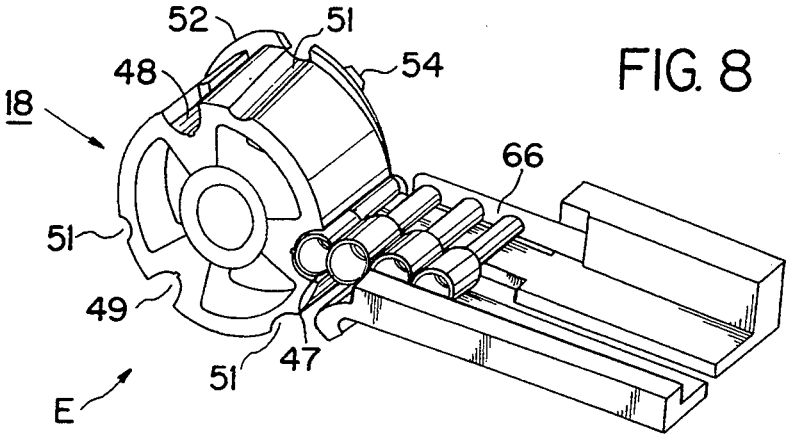
FIG. 8
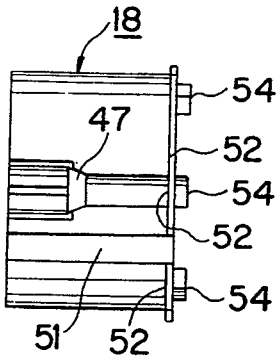
FIG. 9
FIG. 10
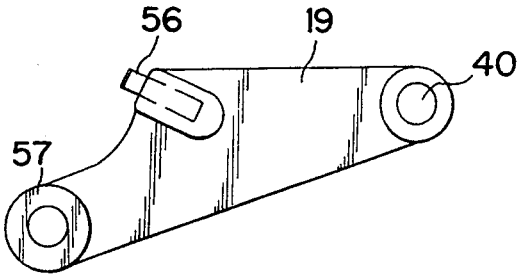
FIG. 11
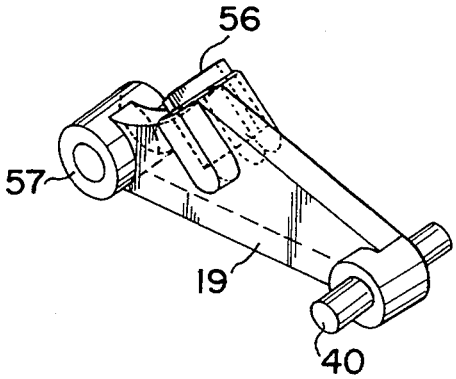
FIG. 12
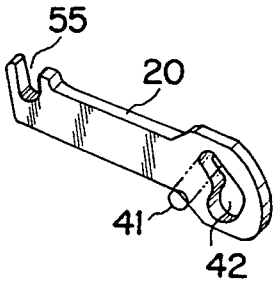
FIG. 13
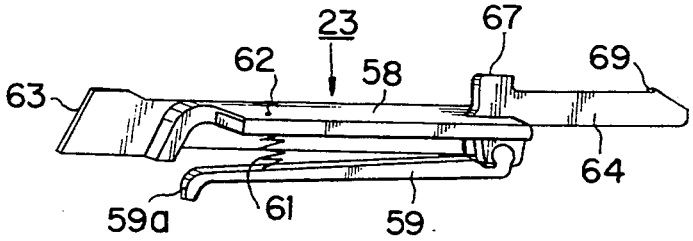

PLIERS FOR DRESSING CONDUCTOR ENDS

FIELD OF THE INVENTION

The invention relates to pliers for dressing conductor ends.

DESCRIPTION OF THE BACKGROUND ART

Such pliers have already been proposed in German Patent Application P 41 36 302.7. These pliers contain two handles which can move relative to one another, a plurality of dressing stations for dressing conductor ends, and a drive device via which the dressing stations can be driven during operation of the handles. Of the dressing stations mentioned, at least one is constructed as an axially displaceable and rotatably supported crimping drum which, in the axially displaced position, can be coupled to the drive device over only one dressing process and in this position can be locked via a flange which projects radially from it.

Particularly in the case of pliers which are used frequently, it has been found that the locking device requires still further improvement with respect to its wear resistance. In addition, it is intended to ensure an even more reliable supply of contact elements of different cross-section which are to be crimped to the conductor ends, when said elements are inserted in the die on the circumference of the crimping drum. If one of the dressing stations is constructed as an insulation-stripping station, then it is furthermore intended to improve further the insulation-stripping process in that it is virtually no longer controlled as a function of movement, in order to produce more uniform insulation-stripping forces and to increase the operating convenience of the pliers.

SUMMARY OF THE INVENTION

In spite of this, the invention is based on the object of developing the pliers of the type mentioned initially such that they have a further improved operating reliability.

Using the pliers according to the invention, conductor ends can be dressed in a different manner, it being possible optionally to connect individual dressing functions of the pliers, to be precise directly by the movement sequence during the dressing process. In this case, at least the crimping station can be coupled to the drive device with the aid of a conductor end which is to be dressed. The crimping station is coupled to the drive device directly in the course of movement of the conductor end, or using the conductor end itself, so that the user does not have to carry out any further setting processes. Thus, in the case of the pliers, there are a plurality of dressing stations which can be driven by the drive device of which, however, not all are permanently driven via the drive device using the movement of the handles. At least the crimping station remains decoupled from the drive device until it is actually required.

In order to improve the operating reliability of this crimping station, according to the invention, a flange extends over the overall circumference of the crimping drum, at least one recess being incorporated in the flange. A locking tab, which is firmly arranged on the body of the pliers and is radially opposite the flange, in this case engages, in the undisplaced axial position of the crimping drum, in the recess and up to a point close to the outer surface of the crimping drum, while, in the axially displaced and rotated position of the crimping drum, the locking tab comes to rest over the outer surface of the crimping drum and engages behind the flange.

In contrast to the conventional construction, in which the flange is formed by radially projecting flaps, this flange is now drawn over the overall circumference of the crimping drum so that it has greater mechanical strength. It can no longer bend so quickly, resulting in a considerably extended life of the crimping drum and thus of the overall pliers.

The locking tab engages radially in the recess and is arranged in a fixed position on the housing of the pliers. If necessary, it can be replaced in a simple manner since it has been designed from the start as a consumable part or spare part. In conventional pliers, the corresponding locking walls could not be replaced. They were nondetachably attached to the housing of the pliers.

In the case of the pliers according to the invention, the locking tab can engage in the recess, preferably in a positively-locking manner, in order to position the crimping drum exactly in the quiescent state, with respect to its rotational position. However, in all cases, the locking tab engages only so far in the recess that it still passes over the outer surface of the crimping drum during axial displacement of the crimping drum and after subsequent rotation of the crimping drum. Thus, the locking tab does not hinder rotation of the crimping drum when said drum has been axially displaced.

A plurality of dies for holding contact elements which are to be crimped on and are of different cross-section are located on the circumference of the crimping drum, for example for crimping on wire end sleeves, as well as a corresponding number of recesses in the flange, of which in each case one is allocated to a die and is located at a predetermined distance therefrom.

This results in it always being possible to lock the crimping drum in its rotational position when a die is located in a loading position provided for all the dies. In this case, the locking tab engages in a flange recess which is allocated to another die.

The recesses in the flange can open into further recesses which are located on the circumference of the crimping drum and are at a predetermined distance from a die, the distance being selected such that a crimping stamp is inserted into the further recess when the associated die is located in the loading position. The recess for the locking tab and the further recess for the crimping stamp can be produced in one operation, as a result of which the production costs of the crimping drum are reduced.

According to a very advantageous refinement of the invention, the locking tab is integrally connected to a retaining bracket which is guided into the crimping position of the crimping drum and is located there close to the outer surface of said crimping drum.

This retaining bracket allows a contact element which is to be crimped on to be positioned reliably when said contact element is located in a die which has been guided into the crimping position. The crimping of a contact element onto a conductor end can then take place even more precisely, which leads to higher operating reliability of the pliers.

The locking tab and the retaining bracket are preferably supported by two rods which are located at a distance from one another and parallel to one another, run parallel to the crimping drum shaft, and are attached to the housing of the pliers.

The parallel rods are inserted at one end into prepared openings which are located laterally in the housing of the pliers. The rod which supports the locking tab is additionally supported at the other rod end in the housing of the pliers. The locking tab and retaining bracket can thus be replaced in a particularly simple manner. Furthermore, the two parallel rods hold the locking tab and retaining bracket in a rotationally secured manner, which leads to exact positioning of these two elements. Furthermore, the rods produce a certain prestressing for the retaining bracket when a contact element located in a die is guided into the crimping position and at the same time presses radially outwards against the retaining bracket. The contact element is thus fixed particularly securely in the die, to be precise independently of the cross-sectional size of the contact element.

According to a further advantageous refinement of the invention, the locking tab can be integrally connected to a control lever which projects from the housing of the pliers, in order to be able to unlock and rotate the crimping drum when said drum is in its normal condition, that is to say not axially displaced and not coupled to the drive device. If the control lever is operated, then the locking tab is guided out of the recess in the flange of the crimping drum so that a desired die can now be moved into the loading position, to be precise by rotating the crimping drum by hand.

The locking tab, retaining bracket, rods and control lever are preferably formed by a single plastic injection-moulded part, which can be produced particularly cost-effectively, so that it can preferably be used as a consumable element.

According to a further very advantageous refinement of the invention, in order further to increase the operating reliability of the pliers, a transportation device which is controlled by the crimping drum is provided in order to feed contact elements which are connected to one another in the form of a strip to a die using a transportation lever which, on its end pointing towards the crimping drum, has a projection which engages between the contact elements and, on its other end, is pivoted underneath a transportation plate, a compression spring which spreads these elements being located between the transportation plate and the transportation lever.

The transportation plate is moved away from the crimping drum and back to it corresponding to the rotational movement of the crimping drum, the transportation lever driving the next contact element during the transportation back, and pushing said element into the die which is now located in the loading position. The transportation lever is of relatively stable design and consists of a stiff arm so that correct transportation of the contact elements and wire end sleeves in the direction of the crimping drum is ensured.

The compression spring may, for example, surround a peg in a helical manner, which peg is firmly connected to the transportation lever and passes through the transportation plate. In this case, the compression spring is supported on the one hand on the underneath of the transportation plate and on the other hand on the transportation lever.

According to a further and likewise very advantageous refinement of the invention, in order to increase the operating reliability, the pliers are provided in the region of the end of the transportation lever pointing towards the crimping drum with a pressing stamp which holds the contact elements down.

This pressing stamp prevents contact elements which are pressed in the direction of the crimping drum by the transportation lever from being able to tilt up in front of the crimping drum when a die is moved back from the crimping position into the loading position, by rotation of the crimping drum, but has not yet reached the loading position.

According to a development of the invention, the pressing stamp is attached to one end of a supporting arm which is located above the transportation plate and whose other end is supported on a lateral wall which limits the movement of the transportation plate in the direction of the crimping drum.

In consequence, the pressing stamp and transportation device form a narrow structural unit.

A latching slide can be arranged above the supporting arm in order to preset the height position of the pressing stamp above the supporting arm. The position of the pressing stamp at right angles to the transportation direction of the contact elements and wire end sleeves can then be selected to correspond to the diameter of the contact elements and wire end sleeves.

For this purpose, a projection is located on the underneath of the latching slide, which projection has an obliquely running guide groove into which a peg which is attached to the supporting arm engages. Since the height position of the latching slide, which is attached to the housing of the pliers on the outside, remains unchanged, the height position of the pressing stamp can vary during horizontal movement thereof, to be precise as a consequence of the obliquely running guide track in which the peg is guided. Indeed, in this case, the vertical movement of the supporting arm is limited such that said arm does not strike against the transportation plate of the transportation device.

According to a further refinement of the invention, another of the dressing stations is an insulation-stripping station which has a clamping jaw which can pivot and can be driven via a toggle joint which is located between the drive device and the moving clamping jaw. Pressure-dependent control of the insulation-stripping station can essentially be implemented with the aid of this toggle joint, which results in convenient handling of the pliers. The movable clamping jaw is no longer driven via an element which rolls away on a control surface of the clamping jaw, so that signs of wear in this respect can no longer occur.

A pulling element can be driven via a toggle lever of the toggle joint, to which pulling element cutting and peeling-off jaws are connected, which are guided in the clamping jaws and are used for cutting and pulling off the conductor insulation. In this case, the toggle lever can strike directly against a projection of the pulling element, via which projection the pulling element is also guided in the housing of the pliers. The pulling element thus does not need to be provided with a further drive projection.

The toggle lever which is connected to the moving clamping jaw preferably has a lateral peg which is guided in a guide track on the body of the pliers. In this case, this guide track is curved upwards in the direction of the rear end of the pliers so that the moving clamping jaw opens the insulation-stripping station when the peg reaches the rear part of this guide.

The pliers may, of course, have further additional dressing stations, for example a cutting station for cutting through conductors. However, this cutting station need not necessarily be driven via the drive device. The cutting device of the cutting station may also be directly attached to the handles.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

An exemplary embodiment of the invention is described in more detail in the following text, making reference to the drawings which are given by way of illustration only, and thus are not limitative of the present invention, and in which:

FIG. 8 shows an enlarged perspective view of the crimping drum with a coordinated supply station for wire end sleeves, FIG. 9 shows a side view of the crimping drum according to FIG. 8, FIG. 10 shows a crimping lever with a crimping stamp inserted, FIG. 11 shows a perspective view of a crimping lever and crimping stamp, FIG. 12 shows a transportation lever of the drive device, to which the crimping drum can be coupled, FIG. 13 shows a perspective view of a transportation device for wire end sleeves.

DETAILED DESCRIPTION OF THE PREFERRED EMBODIMENTS

Figures 1, 2, 3:
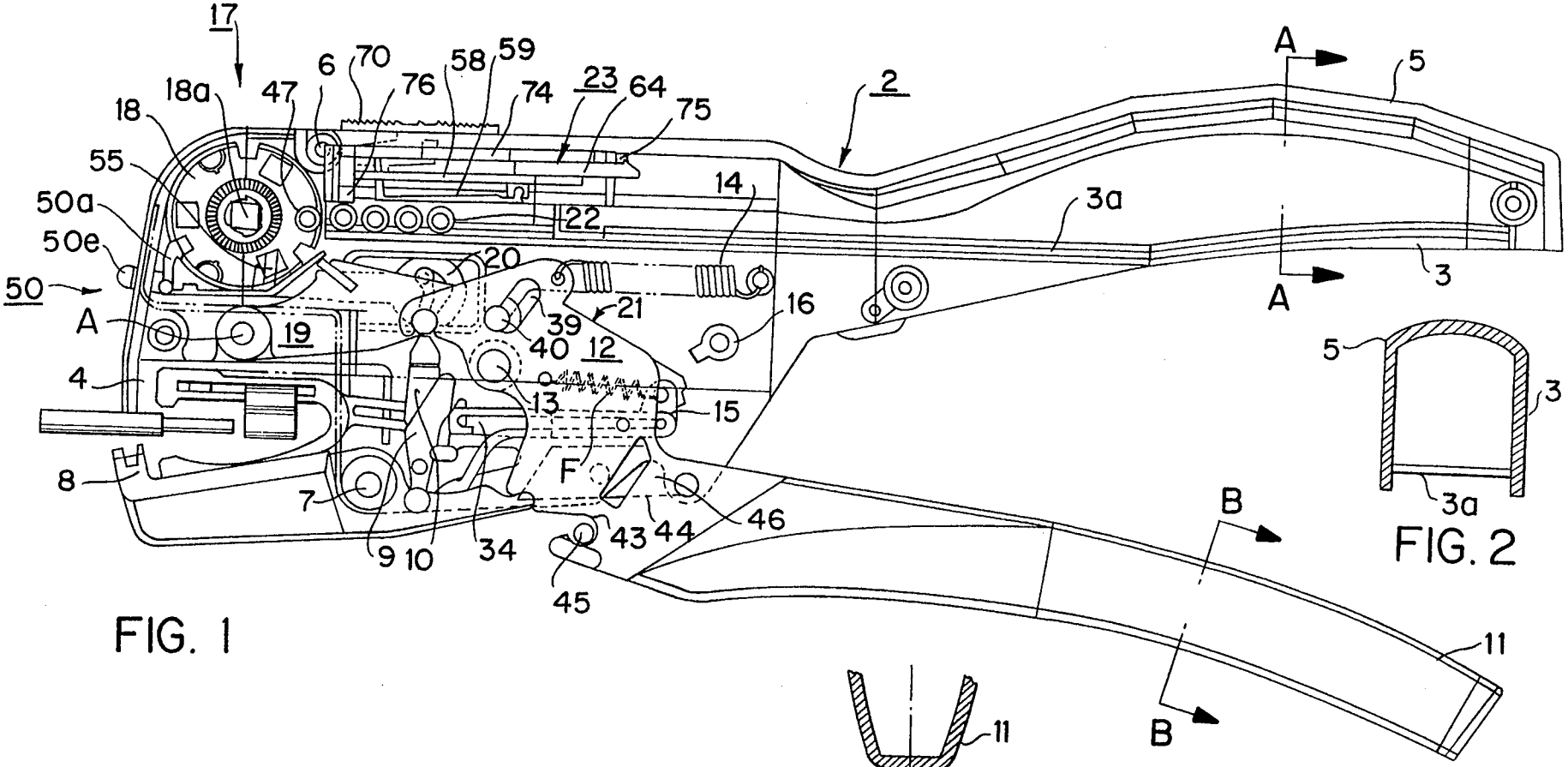
FIG. 1 shows a longitudinal section through the pliers when the handles are not pressed together.
FIG. 2 shows a cross-section through an upper handle of the pliers, along the line A—A in FIG. 1.
FIG. 3 shows a cross-section through a lower handle of the pliers along the line B—B in FIG. 1.

In accordance with FIG. 1, the pliers 1 according to the invention have an integral, hollow body 2, the rear part of which body 2 is formed by an upper and non-moving handle 3. The front part of the body 2 of the pliers is constructed in the form of a stationary clamping jaw 4. A cover 5 of the body 2 of the pliers can pivot about a shaft 6 so that the interior of the body 2 of the pliers is accessible from the upper side of the pliers 1.

A moving clamping jaw 8 is supported in the lower region of the body 2 of the pliers by means of a bearing journal 7 such that it can pivot. Said clamping jaw 8 is located opposite the stationary clamping jaw 4. A toggle joint having a first toggle lever 9 and a second toggle lever 10 is used for driving the moving clamping jaw 8 and acts there on in a region which overhangs the bearing journal 7 at the rear. The toggle joint is described in detail later.

A lower handle 11 of the pliers 1 is integrally connected to a drive part 12, the drive part 12 being supported on the body 2 of the pliers by means of a bearing journal 13 such that it can pivot. The lower handle 11 is thus held on the body 2 of the pliers via the drive part 12 and the bearing journal 13 such that it can pivot, so that a relative movement is possible between the lower handle 11 and the upper handle 3. A tension spring 14 engages above the bearing journal 13 on the drive part 12 and is on the other hand connected to the body 2 of the pliers at a point which is located in the direction of the upper handle 3. The lower handle 11 is thus rotated about the bearing journal 13 in the clockwise direction with the aid of the tension spring 14, so that the tension spring 14 causes the handles 3 and 11 to maintain the spread position continuously.

A short row of teeth and a tooth gap 15 at the rear end of the drive part 12 interact with a spring-loaded blocking hook 16, which is supported in the body 2 of the pliers such that it can rotate, as a block against premature opening of the pliers 1.

Located in the part of the body 2 of the pliers at the top and in front is a crimping station 17 to which a crimping drum 18 and a crimping lever 19 belong. As is still to be explained, the crimping lever 19 is driven with the aid of the drive part 12, while the drive part 12 ensures rotation of the crimping drum 18, to be precise with the aid of a transportation lever 20, which can be seen in FIGS. 4, 6 and 12. The drive part 12, the toggle joint 9, 10 and the transportation lever 20 form a drive device 21.

FIG. 2 shows a cross-section through the upper handle 3 along the line A—A in FIG. 1. As can be seen, the upper handle 3 is constructed in the form of a cavity and, in its lower region, has a base **3*a* which is laterally connected to the walls of the handle 3. The base 3*a* also extends from the handle 3 into the body 2 of the pliers and is guided to a point close to the crimping station 17. In the cavity formed by the base 3*a*, the upper handle 3 and the cover 5, contact elements can be stored which are to be crimped to wire ends, for example wire end sleeves 22 which are arranged adjacent to one another in a chain, in the form of a strip. Said sleeves are fed to the crimping station 17 with the aid of a supply and transportation station 23 which is positioned on the base 3*a*, in the vicinity of the crimping station 17**.

FIG. 3 shows the cross-sectional shape of the lower handle 11 in more detail. This is a cross-section along the line B—B in FIG. 1. The lower handle 11 is constructed to be open in the direction of the upper handle, and essentially to have a U-shape.

The essential components for carrying out the insulation-stripping function are described in more detail in the following text, making reference to FIGS. 4 and 5. Identical elements to those in FIGS. 1 to 3 are provided with identical reference symbols.

Arranged between the stationary clamping jaw 4 (see FIG. 1) and the moving clamping jaw 8 is a pair of cutting jaws 24, 25 which are integrally connected to an elongated pulling element 26. The cutting jaws 24, 25 and the pulling element 26 may be produced, for example, from plastic. The upper cutting jaw 24, which rests on the stationary clamping jaw 4 (see FIG. 1) supports an adjustable end stop 27 for a conductor end 28 which is to be stripped of insulation. The end stop 27 is displaceable in a longitudinal slot 29 in a clamping manner. The cutting jaws 24 and 25 have blades 30 and 31 in the front region in each case, on mutually facing sides, in order to cut through the insulation of the conductor end. The lower cutting jaw 25, which is flexibly or pivotably connected to the upper cutting jaw 24 in its rear region, is guided by the moving clamping jaw 8. When the moving clamping jaw 8 rotates about the bearing journal 7 in the clockwise direction, on the one hand the conductor end 28 is clamped in between the clamping jaws 4 and 8 while, on the other hand, the cutting jaws 24 and 25 are also moved towards one another so that the blades 30 and 31 can cut through the insulation of the conductor end 28. The movement of the lower clamping jaw 8 and hence also of the lower cutting jaw 25 thus takes place by means of the drive of the toggle joint 9, 10, as is still to be explained.

In other respects, the toggle joint 9, 10 is also used for longitudinal displacement of the cutting jaws 24 and 25 in the direction of the handles 3 and 11.

As already mentioned, the upper and lower cutting jaws 24 and 25 are integrally connected to the elongated pulling element 26. This pulling element 26 has two horizontal lateral arms 32 and 33 on opposite sides, which lateral arms 32 and 33 are guided in mutually opposite longitudinal slots 34 (FIG. 1) which are located in the side region of the body 2 of the pliers. The horizontal lateral arms 32 and 33 may have a rectangular or round cross-section. In the event of a rectangular cross-section, rotation of the lateral arms 32 and 33 in the longitudinal slots 34 is not possible.

The horizontal lateral arms 32 and 33 are acted on by the toggle joint 9, 10 when the handles 3 and 11 are being pressed together, in order to displace the elongated pulling element 26 backwards, which is still to be described.

An upwardly pointing eye 35 is located at the rear end of the elongated pulling element 26. A spring F engages in this eye 35, the other end of which spring is connected to a pin S which, for its part, is attached to the drive part 12. When the toggle joint 9, 10 releases the lateral arms 32 and 33, the elongated pulling element 26 and, therewith, the cutting jaws 24 and 25 are thus moved by means of the elastic force of the spring F in the direction of the front side of the pliers again. The component which consists of the upper and lower cutting jaws 24 and 25 and the elongated pulling element 26 can, for simplicity, likewise be designated as an elongated pulling element.

Figure 4:
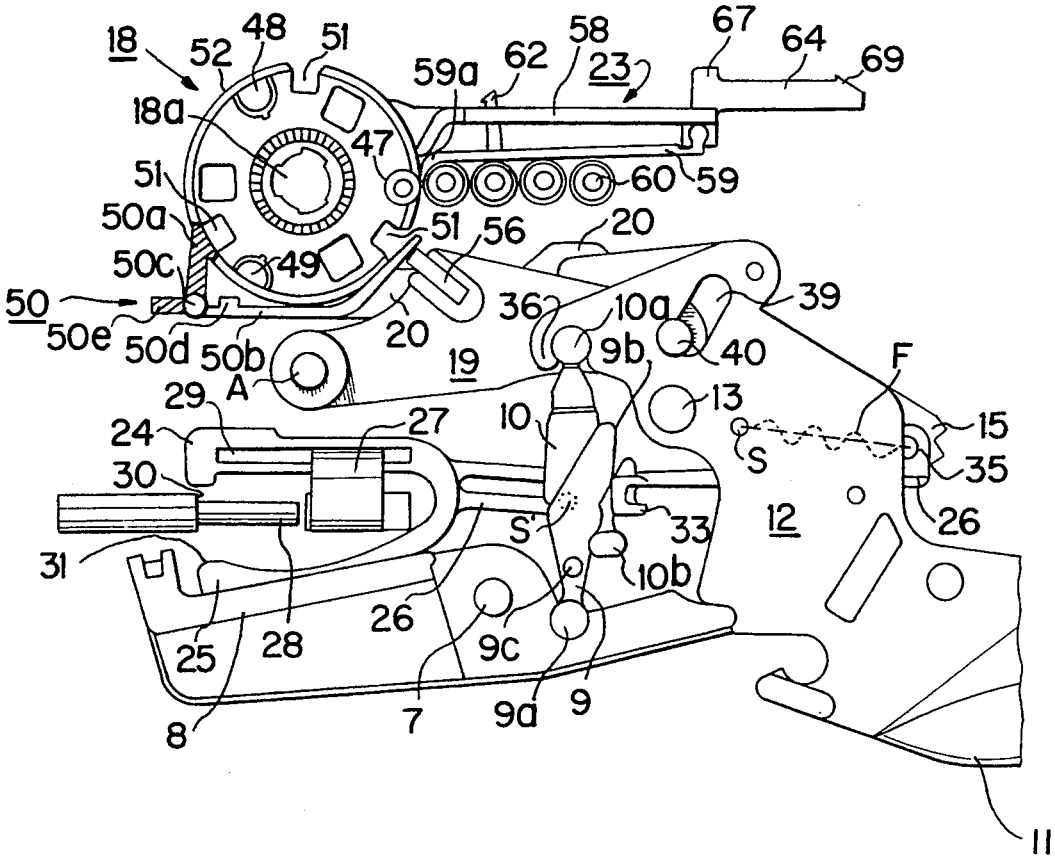
FIG. 4 shows an enlarged longitudinal section through the pliers, in the front region of the pliers.
Figure 5:
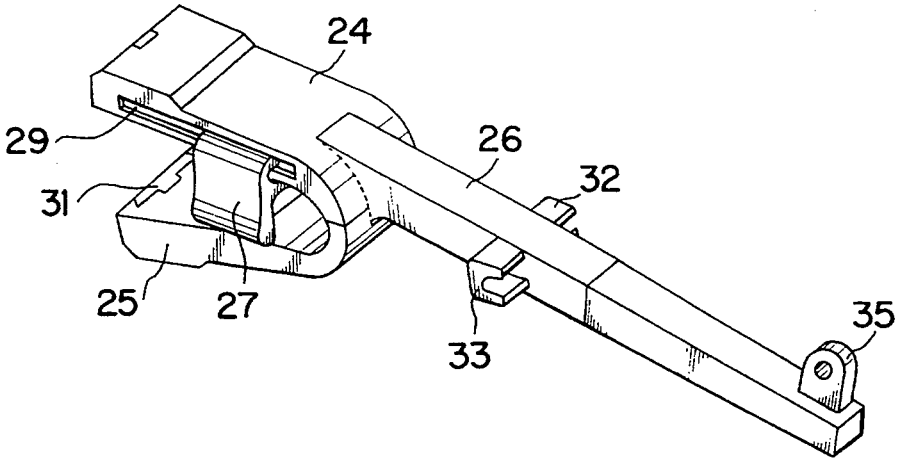
FIG. 5 shows a perspective representation of a pulling element, used for insulation stripping, of the pliers.

As can be seen from FIG. 4, the toggle joint 9, 10 consists of the already-mentioned first toggle lever 9 and the already-mentioned second toggle lever 10. At its lower end, the first toggle lever 9 has a bead **9*a* which is supported in the rear part of the moving clamping jaw 8 such that it can rotate. In its upper part, the second toggle lever 10 likewise has a bead 10*a* which is supported in a bearing 36 of the drive part 12 such that it can rotate. The two toggle levers 9, 10 are connected to one another via a pin S′ such that they can rotate. The toggle lever 9, 10 are thus located between the drive part 12 and the rear end of the moving clamping jaw 8, which overhangs the bearing journal 7 in the direction of the rear end of the pliers. Furthermore, the bearing 36 is located at a position which is displaced in the forward direction of the pliers 1 with respect to the bearing journal 13**.

Thus, if the lower handle 11 is rotated in the direction of the upper handle 3, then the drive part 12 also simultaneously rotates about the bearing journal 13. In this case, the rotation takes place in the anticlockwise direction. This means that the toggle joint 9, 10 is subjected to a pressure force. At the same time, the moving clamping jaw 8 is rotated about the bearing journal 7 in the clockwise direction, that is to say in the direction of the stationary clamping jaw 4, so that the mouth of the pliers closes. If a pressure which is predetermined by the design of the toggle joint 9, 10 is reached, then the toggle joint 9, 10 in FIG. 4 breaks away to the right, that is to say in the direction of the rear end of the pliers 1. At the same time, the lateral arms 32 and 33 are driven by a contact surface **9*b* of the first toggle lever 9 and are moved in the direction of the rear end of the pliers, and the cutting jaws 24 and 25 are also moved with them. Located on the outer side of the first toggle lever 9 is a pin 9*c* which is guided in a guide track, which is not shown, on the inside of the housing of the pliers. This guide track is curved in the rear end such that the mouth of the pliers opens again when the pin 9*c*** reaches this rear end of the guide track. The conductor end which is stripped of insulation can then be taken out from the mouth of the pliers.

If the handles 3 and 11 are released again, they can thus be moved away from one another again because of the tension force of the spring 14, so that, on the one hand, the drive part 12 is rotated in the clockwise direction about the bearing journal 13 so that the toggle joint 9, 10 extends again. At the same time, on the other hand, the elongated pulling element 26 is pushed forwards because of the effect of the elastic spring 35. This continues until a lower projection **10*b* of the second toggle lever 10 strikes against the first toggle lever 9** from the rear.

During the displacement of the elongated pulling element 26 to the rear end of the pliers, the insulation of the conductor end 28 is pulled off the conductor, while the pulled-off insulation falls out at the side from the mouth of the pliers during the opposite movement.

Figure 6:
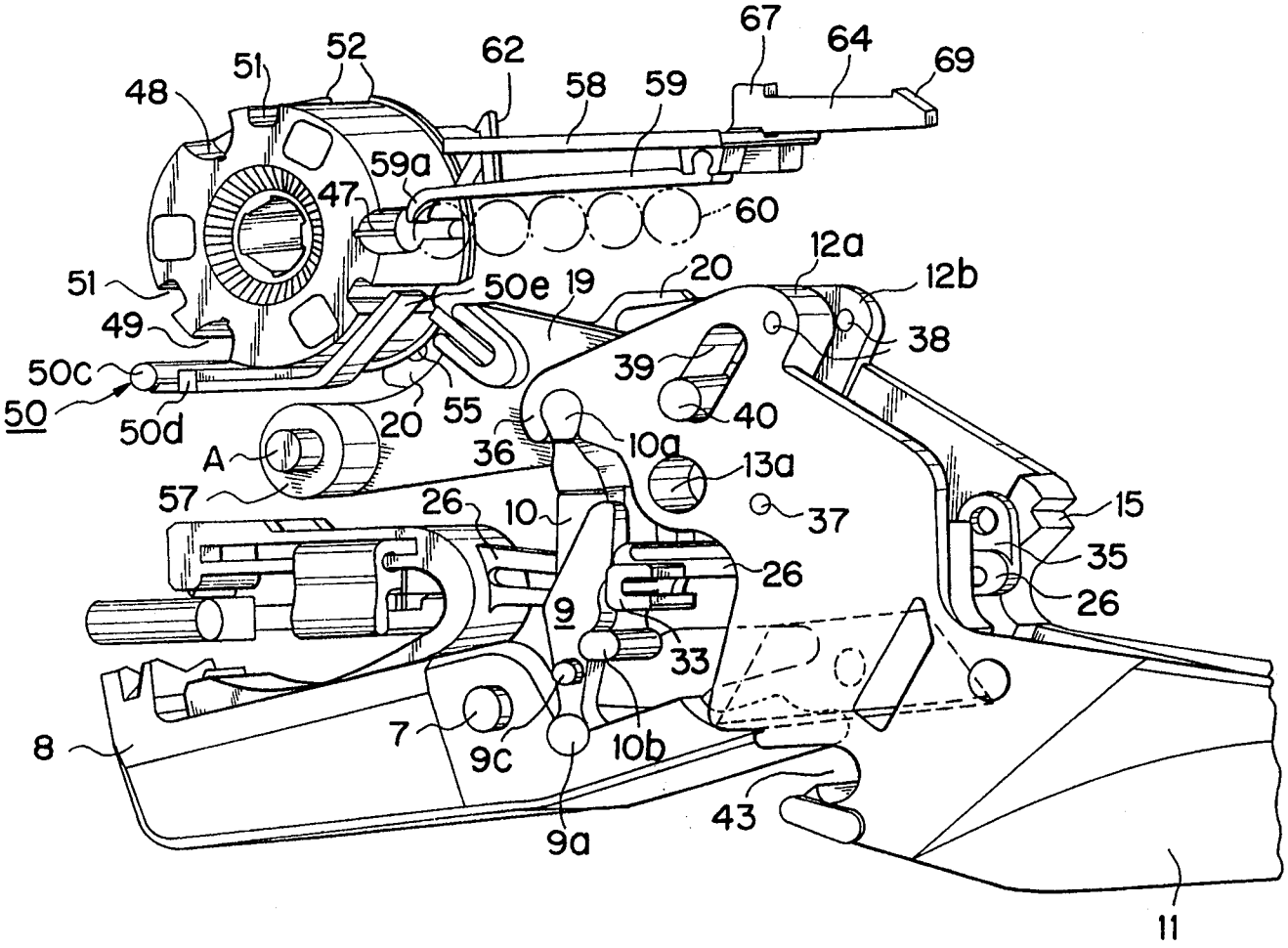
FIG. 6 shows a rear perspective view of the left-hand side of the head of the pliers.
Figure 7:
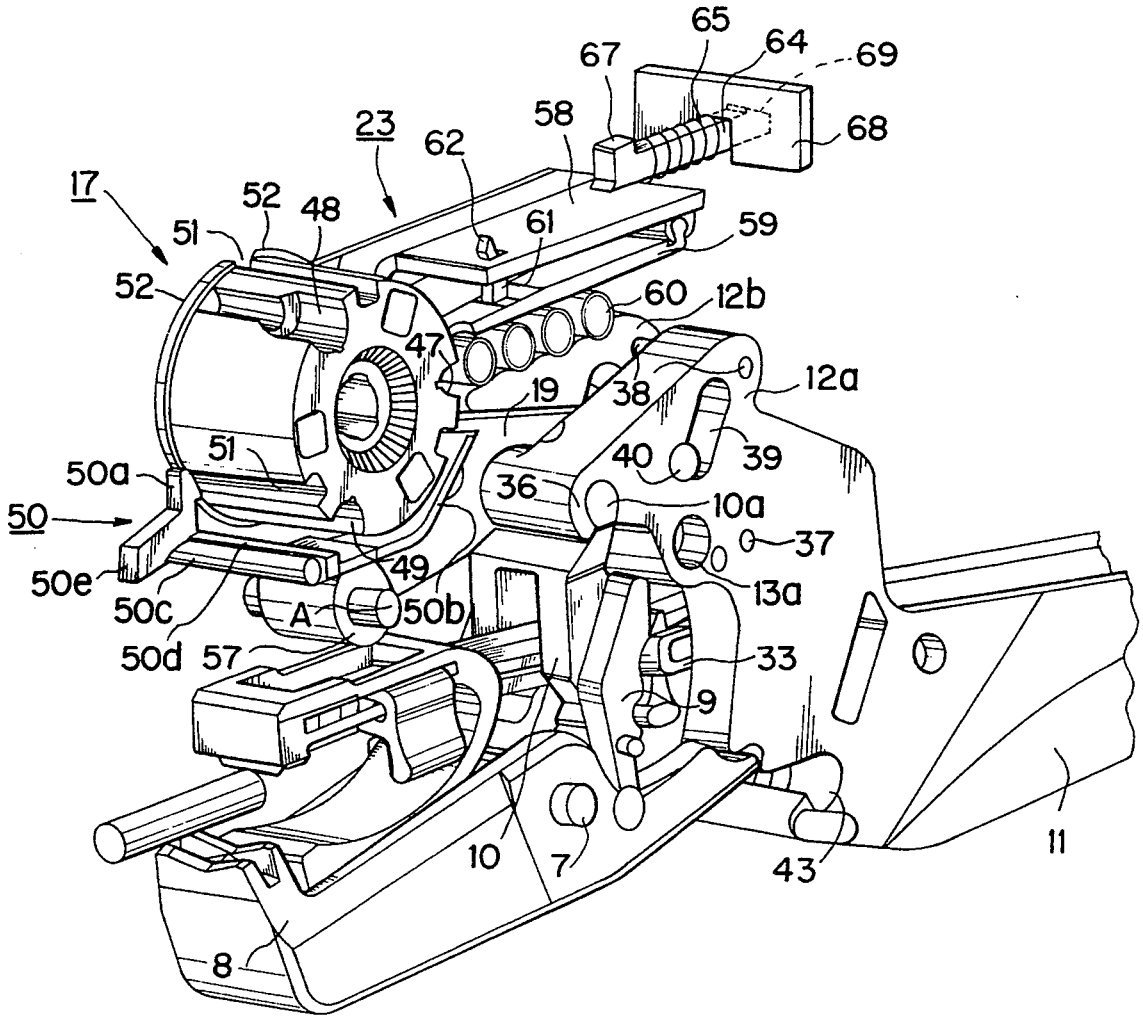
FIG. 7 shows a front perspective view of the left-hand side of the head of the pliers.

FIGS. 6 and 7 show the construction of the pliers in the region of the head of the pliers more precisely.

The drive part 12 is integrally connected to the front part of the lower handle 11, as already explained. The drive part 12 has two wall regions **12*a* and 12*b*, which run parallel to one another, in each case form the extensions of the side walls of the lower handle 11 and, in addition, can also be further laterally reinforced with respect to one another. Openings 37 in the front side walls of the lower handle 11 are used for holding the pin S for attachment of the spring F. The tooth gap 15 is present only on the right-hand wall element 12*b***.

FIG. 6 shows that there is an opening **13*a* for the bearing journal 13 in the left-hand wall element 12*a*, as well as the bearing 36 for holding the one end 10*a* of the second toggle lever 10. Furthermore, openings 38 for the attachment of the tension springs 14 are provided in both wall elements 12*a*, 12*b***.

Furthermore, bent guide tracks 39, in which a peg 40 of a crimping lever 19 is guided, are located in both wall elements **12*a*, 12*b*. This peg 40 passes through both guide tracks 39**, which are arranged superimposed.

A peg 41 (see FIG. 12) which engages in a bent guide track 42 at the end of a transportation lever 20 is furthermore located on the right-hand wall element **12*b*, on its outer side. This transportation lever 20 represents the coupling between the drive part 12 and the crimping drum 18**, as is still to be explained.

Not least, an opposed bearing 43 for holding a conductor which is to be cut up can be seen in FIGS. 6 and 7. This opposing bearing 43 interacts with a blade 44 (FIG. 1) which is guided in the region of the opposing bearing 43 and crosses said opposing bearing 43 when the handles 11 and 3 are pressed together. A conductor which is to be cut up is provided with the reference symbol 45 in FIG. 1. The blade 44 may be attached, for example, to the inner side wall of the body 2 of the pliers. In this case, said blade 44 covers a slot 46 in the side wall into which the conductor can run.

The components of the pliers 1 required for crimping are described in detail in the following text.

In accordance with FIGS. 1 and 4, the crimping drum 18 is supported in the front upper region of the body 2 of the pliers. The crimping drum 18 can rotate about a shaft 18*a* which is attached to opposite side walls of the body 2 of the pliers. The shaft 18*a* runs virtually at right angles to the plane of the pliers. Furthermore, the crimping drum 18 can also be displaced by a certain amount in the axial direction on this shaft 18*a*, it being prestressed forwards in the axial direction with the aid of spring force, that is to say out of the plane of the paper when viewing FIGS. 1 and 4. FIGS. 1 and 4 show a plan view of the front side of the crimping drum 18.

As can furthermore be seen, the crimping drum 18 has a plurality of dies 47, 48, 49, running in the axial direction, on its circumference, as is shown in particular in FIG. 8. These dies 47, 48 and 49 are suitable for holding contact elements which are to be crimped to the conductor ends and may be, for example, wire end sleeves. The dies 47, 48, 49 may be of different size in order to be able to use wire end sleeves of different sizes for conductors having cross-sections of different sizes. The dies 47, 48, 49 are preferably arranged at equal angular intervals on the circumference of the crimping drum 18.

As can be seen in FIGS. 4, 6, 7, 8 and 9, the crimping drum 18 has on its rear side a radially projecting circumferential flange 52 which is present in the overall circumferential region and is interrupted only by recesses 51 which run on the surface of the crimping drum 18 in its axial direction. In this case, each die 47, 48, 49 is allocated one of these recesses 51, which is located in front of the respective die, in the clockwise direction, in the figures. The distance between the die and the associated recess is in this case selected such that the recess is located in the crimping position when the associated die is located in the loading position. For example, the insertion direction for a conductor into the crimping drum 18 is represented by the arrow E in FIG. 8. The dies taper in the insertion direction E and are closed at the rear by the circumferential flange 52. The recesses 51 have the purpose of holding a crimping stamp when the respective die is located in the loading position, as is still to be described.

If a conductor is inserted from the conductor insertion side (from the front in FIG. 8) into a die 47 to 49, to be precise in the arrow direction E, then its tip touches against the circumferential flange 52 which leads, with a corresponding pressure, to the overall crimping drum 18 being displaced axially backwards. During subsequent rotation of the crimping drum 18 in order to transfer the loaded die into the crimping position, the axial position of the crimping drum 18 is then locked, as is still to be described. The axial displacement of the crimping drum can thus be locked for a certain time. When the crimping process has been completed, the crimping drum 18 is then rotated back, whereupon the locking is cancelled again, so that the crimping drum 18 can be displaced axially forwards again, as a consequence of the spring force, to be precise into its original position.

A locking element 50 is used for locking the crimping drum 18 both in its circumferential direction and in its axial direction. The locking element 50 has a locking tab 50*a*, a retaining bracket 50*b*, two parallel rods 50*c* and 50*d* and a control lever 50*e*. All the elements 50*a* to 50*e* are integrally connected to one another and consist, for example, of plastic. The locking element 50 can best be seen in FIGS. 4, 6 and 7.

The two rods 50*c* and 50*d* which run parallel to one another and parallel to the shaft 18*a* of the crimping drum 18 are in each case firmly inserted at the same end into corresponding recesses which are located on the inner side wall of the housing 2 of the pliers. Connected to the rod 50*c* at this end is the locking tab 50*a*, which engages in one of the recesses 51, to be precise in the region of the circumferential flange 52, when the crimping drum 18 is located in the quiescent position or in the position where it is not displaced axially. In this case, the locking tab 50*a* engages only so far into the recess 51 that its tip comes to rest not deeper than the outer surface of the crimping drum 18. In this condition, the crimping drum 18 can thus no longer be rotated, since the locking tab 50 is located in the circumferential movement track of the circumferential flange 52. The crimping drum 18 is thus locked, a die, in this case the die 47, being located in the loading position. If, in this condition, another die is intended to be moved into the loading position, then the control lever 50*e* can be operated in such a manner that the locking tab 50*a* is rotated out of the track of the circumferential flange 52 about the rod 50*c*, which is used as a shaft. The crimping drum 18 can now be rotated, to be precise by hand and over a corresponding opening in the housing 2 of the pliers. If another die has been moved into the loading position, the locking tab 50*a* then latches into a corresponding recess 51 again. The rod 50*c* is additionally supported in the housing 2 of the pliers at its other end, while the rod 50*d* is not held in the housing of the pliers at this end.

Furthermore, the retaining bracket 50*b*, which runs underneath the crimping drum 18 and is guided into the crimping position, is attached to both rods 50*c* and 50*d*. The retaining bracket 50*b* is located on the rod end facing away from the locking tab 50*a*. The tip of the retaining bracket 50*b* in this case comes to rest laterally with respect to a crimping stamp, which is still to be described, and in the vicinity of the circumference of the crimping drum 18. If a wire end sleeve located in a die is guided by rotation of the crimping drum 18 into the crimping position, it is pressed radially into the die there with the aid of the retaining bracket 50*b*, and is hence fixed, so that a correct crimping process can take place.

The retaining bracket 50*b* is also supported on the rod 50*d*, as a result of which it is prestressed in an elastically sprung manner in the direction of the crimping drum 18. The locking tab 50*a* and the retaining bracket 50*b* are thus located at different ends of the retaining rod 50*c*. Furthermore, the rods 50*c* and 50*d* may have a different cross-section. That mentioned first may have a round cross-section, while that mentioned last may have a quadrilateral cross-section.

If the crimping drum 18 is displaced axially, to be precise in the direction of the arrow E in FIG. 8, in order to be coupled to the drive device, the circumferential flange 52 is also displaced relative to the locking tab 50*a* so that now, in the event of rotation of the crimping drum 18, the locking tab 50*a* comes to rest above the outer surface of the crimping drum 18, and laterally with respect to the circumferential flange 52. Since the locking tab 50*a* is firmly positioned in the axial direction of the crimping drum 18, the latter is now fixed in its axial position in the axial direction by means of the locking tab 50*a*, since the circumferential flange 52 is now pressed against the side of the locking tab 50*a*. The locking tab 50*a* does not return to the region of the recess 51 until the crimping drum 18 has been rotated back into its original position, so that the crimping drum 18 can now be moved back axially forwards into the original position.

There are projections 54 on the rear side of the crimping drum 18, which projections 54 run axially with respect to the dies 47 to 49 at a predetermined angular interval, as FIGS. 8 and 9 show best. If the crimping drum 18 is axially displaced in the arrow direction E by inserting a conductor end into a die 47 to 49, then, at the same time, one of the projections 54 also engages with a vertical slot 55 at the other end of the transportation lever 20. This is shown in FIG. 12. Since the crimping drum 18 is now locked in its rearward axial position by the crimping tab 50*a*, the crimping drum 18 can now be rotated via the transportation lever 20, with the aid of the drive part 12. Overall, while the handles 3 and 11 are being pressed together and during the subsequent spreading process, a movement of the crimping drum takes place in which a die is initially rotated out of the loading position into the crimping position, and is subsequently rotated back into the loading position. In the present example, three dies are provided for contact elements or wire end sleeves. For example, the respective dies may hold wire end sleeves for cross-sectional sizes of 0.5/0.75 and 1/1.5 and 2.5 $mm^2$. In order that the conductor end can follow the rotational movement of the crimping drum 18, a corresponding slot like a circular segment is located on the wall of the body 2 of the pliers.

FIG. 12 shows the detailed construction of the transportation lever 20. It consists of a plate which is constructed in the form of a key and has the vertical slot 55 at its front end and a bent guide slot 42 at its rear end whose aperture angle is directed towards the vertical slot 55. The transportation lever 20 may be guided between the rear wall of the body 2 of the pliers and the rear side of the wall element 12*b*.

FIGS. 10 and 11 precisely show the construction of the already previously mentioned crimping lever 19. The crimping lever 19 supports a crimping stamp 56, which is brought forward in a suitable manner to an element which is to be crimped when said element has been moved into the crimping position by the crimping drum 18. For this purpose, the crimping lever 19 has on its lower end a bearing device 57 via which it is supported in the body 2 of the pliers such that it can pivot. The bearing device 57 may be, for example, a reinforced hollow cylinder through which a shaft A runs (FIGS. 4, 6 and 7) which is attached to the body 2 of the pliers. The crimping lever 19 can then pivot about the shaft A.

At the end of the crimping lever 19 opposite the bearing device 57, said lever is provided with the already-mentioned peg 40, which runs parallel to the shaft of the bearing device 57. With this peg 40, the crimping lever 19 engages into the bent guide track 39, which is located inside the drive part 12, to be more precise within both wall regions 12*a* and 12*b*. In consequence, a particularly stable connection between the drive part 12 and the crimping lever 19 is achieved.

FIGS. 4 and 13 respectively show a side view and a perspective view of a transportation device for the wire end sleeves. This transportation device, which is provided with the reference symbol 23, has a transportation plate 58 which can move towards the crimping drum 18 and away from said crimping drum 18. Located on the lower side of the transportation plate 58 is a transportation lever 59 which, on its end pointing towards the crimping drum 18, has a projection 59*a* which engages between the wire end sleeves. On its other end, the transportation lever 59 is articulated on the transportation plate 58 such that it can pivot, there being a compression spring 61 between the transportation plate 58 and the transportation lever 59, which compression spring 61 spreads the two elements. The compression spring 61 surrounds a peg 62 in a helical manner (see FIG. 7), which peg is firmly connected to the transportation lever 59 and passes upwardly through the transportation plate 58. At the same time, the compression spring 61 is supported on the elements 58 and 59. If the crimping drum 18 is displaced axially with the aid of a conductor end such that the circumferential flange 52 comes to rest behind the locking tab 50*a*, and if the crimping drum 18 is then rotated out of the loading position into the crimping position, one of the projections 54 located at the top thus drives the transportation plate 58, in other words presses said transportation plate 58 away from the crimping drum 18, to be precise over an abutting incline 63 for the projection 54. The abutting incline 63 can be seen best in FIG. 13. When the transportation plate 58 is moved away from the crimping drum 18 by the projection 54, a spring 65 which is located on an extension 64 of the transportation device 23 is tensioned such that, when the crimping drum 18 has reached its loading position again and it has been displaced axially forwards again, the transportation plate 58 and, with it, the transportation lever 59 are moved via the tension spring 65 towards the crimping drum 18, and the next wire end sleeve 60 is pushed into the die located in the loading position. An elastic element 66 is used for guiding the wire end sleeves 60 back into their axial original position.

During the movement of the transportation device 23 away from the crimping drum 18, the transportation lever 59 slides away only over the wire end sleeves 60, since it is supported flexibly. The compression spring 65, which is stressed during this movement, is supported on the one hand on a projection 67 of the extension 64 and on the other hand on a lateral wall 68, through which the extension 64 runs, as can be seen in FIG. 7. In contrast, the movement of the transportation device 23 in the direction of the crimping drum 18 is limited by a hook-shaped construction 69 on the free end of the extension 64, which construction strikes against the lateral wall 68 from the rear. This lateral wall 68 is firmly mounted in the upper handle 3. The transportation device 23 is mounted on the cover 5 so that it is also raised when the cover 5 is raised. In this case, the transportation plate 58 can be supported in lateral guide tracks in the interior of the cover side walls.

Figure 14:
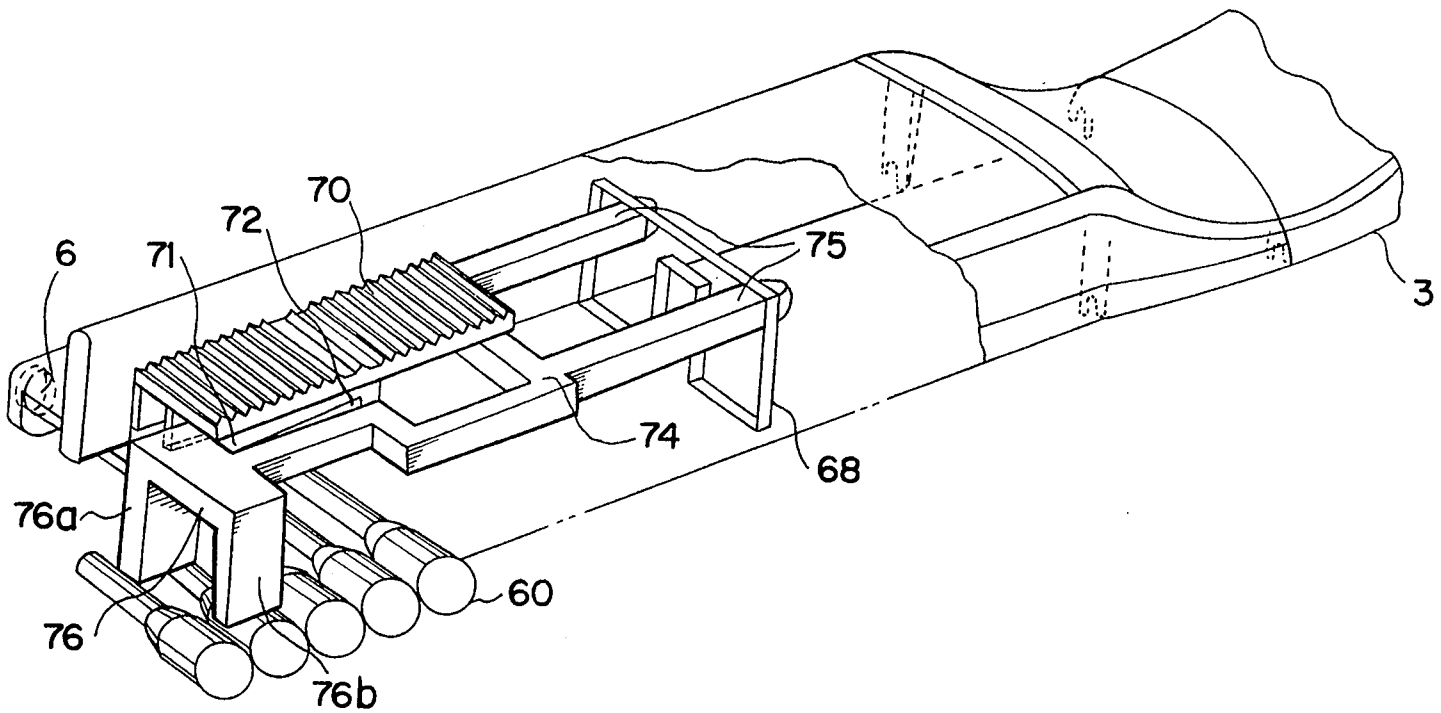
FIG. 14 shows a perspective representation of the front end of the upper handle of the pliers in the region of a pressing stamp.
Figure 15:
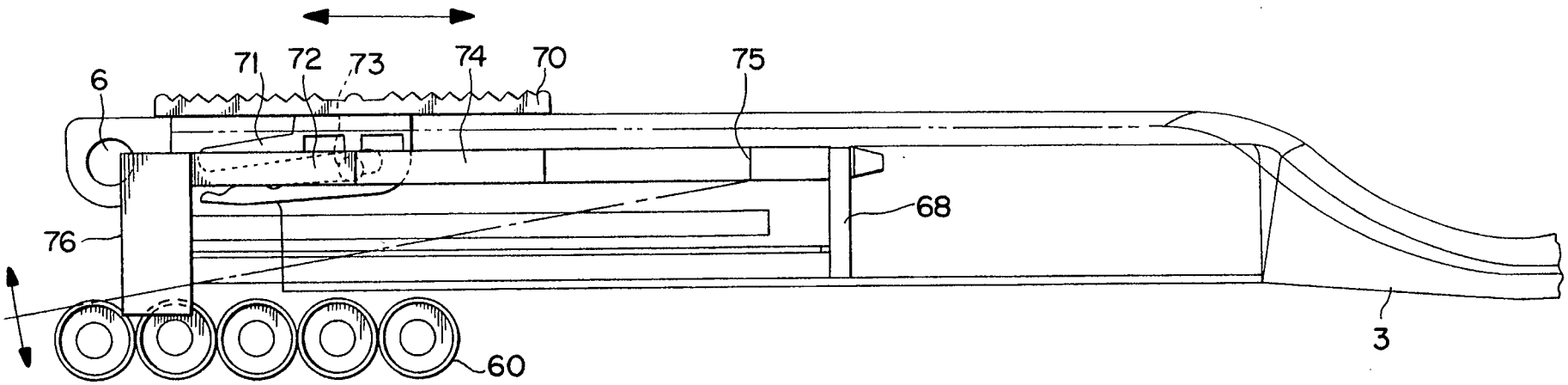
FIG. 15 shows a longitudinal section through the upper handle of the pliers according to FIG. 14.

FIGS. 14 and 15 show the construction of the upper handle 3 in the region of its front end, in detail. Arranged on its top is a latching slide 70 which can be displaced in the direction of the forward end and rear end of the pliers. Integrally formed on the underneath of the latching slide 70 is a projection 71, which has an obliquely running guide groove 72. This guide groove 72 runs obliquely downwards in the longitudinal direction of the handle 3 and in the direction of the front end of the pliers. A peg 73 on a supporting arm 74, which has rear projections 75 which are supported firmly in the lateral wall 68, engages in said handle 3. A rotation point for the supporting arm 74, so to speak, is formed there, which rotation point is located virtually underneath the upper cover of the handle 3. Located on the end of the supporting arm 74 which is at the front and faces the crimping drum 18 is a pressing stamp 76, of U-shaped construction, whose two limbs **76*a* and 76*b* are adjusted to the wire end sleeves 60 and act thereon. Depending on the diameter of the wire end sleeves 60, the latching slide 70 can then be displaced such that the pressing stamp 76 comes to rest on the wire end sleeves 60 in order to prevent them tilting up in the region directly in front of the crimping drum 18, as a result of the pushing force of the transportation lever 59**.

The transportation lever 59 of the transportation device 23 comes to rest between the limbs **76*a* and 76*b* of the pressing stamp 76, the transportation device 23 being located directly underneath the supporting arm 74. The limbs 76*a* and 76*b* of the pressing stamp 76 may be of different length, in order to press down the wire end sleeves 60 in the region of their metallic sleeve and in the region of their insulation ring, the diameters being different in these regions. If the cover 5 is raised, then the supporting arm 74** is also raised. Wire end sleeves can now be replenished.

The method of operation of the pliers 1 during crimping is described in more detail in the following text.

If a conductor end is inserted into the die 47 which is located in the loading position, the crimping drum 18 is in consequence displaced axially backwards, to be precise against a spring force. At the same time, the circumferential flange 52 moves into an axial position which is displaced with respect to the locking tab **50*a*. At the same time, the projection 54, which is allocated to the die 47 located in the loading position, engages with the vertical slot 55 in the transportation lever 20. If the handles 3 and 11 are now moved towards one another, then the circumferential flange 52 moves behind the locking tab 50*a*, so that the axial position of the crimping drum 18 is thus locked. At the same time, the die 47** moves out of the loading position in the direction of the crimping position.

While the handles 11 and 3 are being pressed together, the drive part 12 rotates about the bearing journal 13, to be precise in the anticlockwise direction in the figures. At the same time, the transportation lever 20 is initially displaced in the direction of the crimping drum 18, since the peg 41 is located in the upper region of the guide 42 which is of angular construction. This means that the crimping drum 18 initially rotates as a result of the movement of the transportation lever 20. At the same time, the die 47 moves out of the loading position into the crimping position before the crimping lever 19 rotates. During the time in which the crimping drum 18 is rotating about the aforementioned path, the peg 40 moves only in the horizontally lying branch within the angular guide 39, so that the crimping lever 19 is initially not driven during the movement of the drive part 12.

If, after reaching the crimping position, the handles 3 and 11 are further pressed together by the die 47, then the peg 40 of the crimping lever 19 now runs upwards in the vertical branch of the guide 39, so that the crimping lever 19 is rotated about its bearing shaft A, in the anticlockwise direction. At the same time, the crimping stamp 56 is pressed into the wire end sleeve which is at this time located in the crimping position.

During this last part of the movement of the handles 3 and 11, the peg 41 runs in the lower branch of the guide 42, to be precise from the center downwards, so that the transportation lever 20 is not moved further. Thus, if the crimping stamp 56 is pressed against the wire end sleeve, the crimping drum 18 remains at rest.

If the load on the handles 3 and 11 is subsequently relieved, then the spring 14 causes the handles 3 and 11 to spread. The spring 14 thus pulls the drive part 12 in the clockwise direction about the bearing journal 13. At the same time, on the one hand, the peg 41 runs in the lower branch of the guide 42 as far as its central region, without the transportation lever 20 being moved back in consequence. The crimping drum 18 thus initially remains at rest. On the other hand, during this first spreading phase, the peg 40 in contrast runs downwards in the vertical branch of the guide 39, so that the crimping lever 19 is rotated about the bearing shaft A in the clockwise direction. The crimping stamp 56 is thus removed from the crimping drum 18. If the peg 41 is located in the central region of the guide 42 and the peg 40 in the lower region of the vertical branch of the guide 39, then the next movement phase starts. Specifically, the peg 41 now runs in the upper region of the guide 42 and in consequence pulls the transportation lever 20 back in the direction of the handles 3 and 11. The peg 54 is thus driven via the vertical slot 55, which results in rotation of the crimping drum 18 in the anticlockwise direction. The die 47 is thus moved back into the loading position again. During this second movement phase, the crimping lever 19 remains virtually at rest, since the peg 40 now still runs only in the horizontal branch of the guide 39.

As soon as the die 47 has reached its loading position, the transportation lever 20 has been completely moved back (to the right in FIG. 4), the circumferential flange 42 comes free of the locking tab **50*a*, so that the crimping drum 18 is pushed forwards again, to be precise because of the spring which is arranged between it and the rear wall of the body 2 of the pliers. At the same time, the projection 54 is also removed from the vertical slot 55, so that there is no longer any coupling between the transportation lever 20 and the crimping drum 18. At the same time, the rearward movement of the crimping drum 18, that is to say the axial rearward displacement, releases the abutting incline 63, since the projection 54 lying on it is also pulled back. As a consequence of the force of the spring 65, the transportation plate 58 can thus push a further wire end sleeve 60** into the die located in the loading position.

It should be mentioned that, as a consequence of the rotation of the crimping drum 18 in the clockwise direction and in the anticlockwise direction, the crimping drum 18 is moved back into the axial original position again after each movement cycle, that is to say it is decoupled from the drive device and the transportation lever 20.

If the crimping drum 18 is not displaced axially by a conductor end, then no coupling takes place between the projection 54 and the transportation lever 20. Nevertheless, the same processes as those described above take place when the handles 3 and 11 are moved together. On the one hand, the transportation lever 20 is now also moved in a reciprocating manner while, on the other hand, the crimping lever 19 is pivoted about a pivoting shaft A. The crimping stamp 56 is thus always moved into the crimping position, even when the die should be located in the loading position. In order to avoid damage to the crimping drum 18 in this case, said crimping drum has the recesses 51 in its surface, as already mentioned. These recesses are located in the crimping position when the associated die is located in the loading position. The crimping stamp 56 can thus carry out its full movement even in the last mentioned case.

We claim:

1. Pliers for dressing conductor ends comprising two handles movable relative to one another, a plurality of dressing stations for dressing the conductor ends during dressing processes, and a drive device via which the dressing stations can be driven when the handles are operated, one of which dressing stations is constructed as a crimping drum which is displaceable axially and is supported for rotation and is couplable to the drive device is the axially displaced position over only one dressing process, and in this position can be locked via a flange projecting radially from the crimping drum, the flange extends over the overall circumference of the crimping drum, at least one recess is incorporated in the flange, and a locking tab is arranged in a fixed position on the body of the pliers, the locking tab is radially opposite the flange and engages, in the undisplaced axial position of the crimping drum, in the recess and up to a point close to the outer surface of the crimping drum, and, in the axially displaced and rotated position of the crimping drum, the locking tab comes to rest over its outer surface and is positioned behind the flange.

2. Pliers according to claim 1, wherein the crimping drum has on its circumference a plurality of dies for holding contact elements which are to be crimped on and are of different size, as well as a corresponding number of recesses in the flange, of which in each case one recess is allocated to a die.

3. Pliers according to claim 1, wherein the recesses in the flange open into further recesses, which are located on the circumference of the crimping drum and at a predetermined distance from a die.

4. Pliers according to claim 1, wherein the locking tab is integrally connected to a retaining bracket which is guided into the crimping position of the crimping drum, and is located close to the outer surface of said drum.

5. Pliers according to claim 4, wherein the locking tab and the retaining bracket are supported by two rods, which are located at a distance from one another and parallel to one another, run parallel to the crimping drum shaft, and are attached to the housing of the pliers.

6. Pliers according to claim 1, wherein the locking tab is integrally connected to a control lever which projects from the housing of the pliers.

7. Pliers according to claim 6, wherein the locking tab, retaining bracket, rods and control lever are formed by a single plastic injection-moulded part.

8. Pliers according to claim 1, further comprising a transportation device which is controlled by the crimping drum, the transportation device feeds contact elements, which are connected to one another in the form of a strip, to a die, using a transportation lever which, on its end pointing towards the crimping drum, has a projection which engages between the contact elements and, on its other end, is pivoted underneath a transportation plate, a compression spring which spreads these elements being located between the transportation plate and the transportation lever.

9. Pliers according to claim 8, wherein the compression spring surrounds a peg in a helical manner, which peg is firmly connected to the transportation lever and passes through the transportation plate.

10. Pliers according to claim 8, further comprising a pressing stamp which holds down the contact elements, the pressing stamp being positioned in the region of the end of the transportation lever pointing towards the crimping drum.

11. Pliers according to claim 10, wherein the pressing stamp is attached to one end of a supporting arm which is located above the transportation plate and whose other end is supported on a lateral wall which limits movement of the transportation plate in the direction of the crimping drum.

12. Pliers according to claim 11, further comprising a latching slide positioned above the supporting arm for presetting a height position of the pressing stamp above the supporting arm.

13. Pliers according to claim 12, further comprising a projection having an obliquely running guide groove being attached underneath the latching slide, into which guide groove a peg which is attached to the supporting arm engages.

14. Pliers according to claim 1, further comprising another of the dressing stations being an insulation-stripping station, which has a pivotable clamping jaw drivable via a toggle joint which is located between the drive device and the moving clamping jaw.

15. Pliers according to claim 14, further comprising a toggle lever of the toggle joint which drives a pulling element to which cutting and peeling-off jaws are connected, which are guided in the clamping jaws.

16. Pliers according to claim 15, wherein the toggle lever which is connected to the moving clamping jaw has, on a side thereof, a peg which is guided in a guide track on the body of the pliers.

* * * * *